US005901836A

United States Patent [19]

Taniuchi

[11] Patent Number: 5,901,836

[45] Date of Patent: May 11, 1999

[54] LIGHTING KNOB SWITCH

[75] Inventor: Ryoichi Taniuchi, Tsuruga, Japan

[73] Assignee: Matsushita Electric Industrial Co., Ltd., Japan

[21] Appl. No.: 09/052,052

[22] Filed: Mar. 30, 1998

[30] Foreign Application Priority Data

Apr. 4, 1997 [JP] Japan ..... 9-86390

[51] Int. Cl.[6] ..... H01H 9/00

[52] U.S. Cl. ..... 200/316; 200/314

[58] Field of Search ..... 200/1 R, 4, 5 R, 200/11 R–11 K, 308–317, 336, 341, 318.2, 566, 564, 520, 530–532, 17 R, 18

[56] References Cited

U.S. PATENT DOCUMENTS

| | | | |
|---|---|---|---|
| 2,753,432 | 7/1956 | Long et al. | 219/20 |
| 3,184,557 | 5/1965 | Clarey | 200/4 |
| 3,588,420 | 6/1971 | Conrad | 200/167 |
| 4,104,981 | 8/1978 | Ono et al. | 116/124 L |
| 4,131,033 | 12/1978 | Wright et al. | 74/553 |
| 4,245,141 | 1/1981 | Aspden | 200/314 |
| 4,264,799 | 4/1981 | Aspden | 200/314 |
| 4,370,532 | 1/1983 | Green | 200/314 |
| 4,394,546 | 7/1983 | Harumatsu | 200/5 R |
| 4,775,767 | 10/1988 | Sawada et al. | 200/310 |
| 5,128,842 | 7/1992 | Kenmochi | 362/95 |
| 5,180,050 | 1/1993 | Rada et al. | 200/329 |
| 5,204,502 | 4/1993 | Ferris et al. | 200/4 |
| 5,258,593 | 11/1993 | Hayakawa | 200/315 |
| 5,581,251 | 12/1996 | McRight | 341/22 |
| 5,711,588 | 1/1998 | Rudisill | 362/30 |

FOREIGN PATENT DOCUMENTS

| | | | |
|---|---|---|---|
| 3808770A1 | 9/1989 | Germany | H01C 10/14 |

*Primary Examiner*—Michael A. Friedhofer
*Attorney, Agent, or Firm*—Rossi & Associates

[57] ABSTRACT

A lighting-knob-switch comprises a first light conductor shaped in a cylinder or an oval-top pillar. The first light conductor has a light interceptor (22B) having a concave slope on its rear end and has a lighting face (22A) on its front end. The lighting knob switch further comprises a knob which houses the first light conductor axially, an opening (21C) under the light interceptor (22B) of the first light conductor (22), and a first light emitter (35) under the light interceptor (22B). The light from the first light emitter (35) reflects on the light interceptor (22B) through the opening (21C) and arrives at the lighting face (22A). This construction allows the lighting face (22A) to receive even light at anytime, realizes an easy assembly work, and achieves an inexpensive cost.

7 Claims, 6 Drawing Sheets

LIGHTING KNOB SWITCH

FIELD OF THE INVENTION

The present invention relates to a lighting-knob-switch used in a wide range of electronics products.

BACKGROUND OF THE INVENTION

A conventional lighting-knob-switch is described by referring to FIG. 8 and FIG. 9. FIG. 8 is a cross section and FIG. 9 is a perspective exploded view of the conventional lighting-knob-switch. In those drawings, a knob 1 made of plastic is engaged with a light conductor 2 made of plastic disposed at the back of the knob 1. A protrusion 2A for lighting disposed at the center of the light conductor 2 is inserted into a center hole 1A of the knob 1. A plate 3 on which a character of the switch mode is drawn is mounted to the protrusion 2A for lighting.

A back-free type box case 4 houses a rotor 5 rotatively, and a first terminal plate 6 is disposed at an open back of the case 4. In front of the first terminal plate 6, a plurality of fixed points 7 are disposed. A rotative shaft 6A, which is a front part of a rotor 5, extends through a hole 4A punched on the front end of the case 4, and a tip of the rotative shaft 5A is engaged and secured with a rotative shaft 2A of the light conductor 2. A press spring 8 and a contact reed 9 are mounted to a back of the rotor 5, where the contact reed 9 is forced to touch elastically the fixed contacts 7 by the press spring 8. A light emitter 10, such as a small bulb or a light emitting diode, is mounted to the back of the light conductor 2. A second terminal plate 11 on which a connector 12 and other electric parts (not shown) are mounted is disposed on a rear side of the bottom plate of the case 4. An elastic lead wire 13 couples the light emitter 10 to the second terminal plate 11, and its center part coils around the rotative shaft 2B in several turns for allowing a rotation of the conductor 2 and the knob 1.

In the above structure, when the knob I is turned, the rotative shaft 2B rotates the rotor 5 via the rotative shaft 5A, and the contact reed 9 mounted on the back of the rotor 5 is forced to elastically touch the fixed contacts 7 and rotates, thus an electrical contact between the plurality of fixed contacts 7 is on and off due to the elastic rotation.

When an electrical signal from an apparatus (not shown) is fed into the light emitter to turn it on via the connector 12, the electrical signal runs through the lead wire 13 and turns on the light emitter 10. The entire light conductor 2 is lit by illumination from the light emitter 10. The light running through the protrusion 2A lights up the switch mode character on the plate 3.

In the above conventional structure, the luminance of the protrusion 2A is likely to be uneven depending on a size of the light conductor 2, because the light emitter 10 mounted at periphery of the light conductor 2 lights up the entire light conductor 2, and thereby illuminating the protrusion 2A. In addition, the center part of the lead wire 13 are coiled around the rotative shaft 2B in several turns, which causes difficulties as well as takes an extra time in an assembly work.

SUMMARY OF THE INVENTION

The present invention addresses the above problems and aims to provide a lighting-knob-switch having even luminance, and being assembled with ease at an inexpensive cost.

The lighting-knob-switch of the present invention comprises the following elements:

(a) a first light conductor in a cylindrical shape or any other pillar shapes, having a light interceptor with a concave slope at a rear end and a lighting face at a front end, (b) a knob which houses the first light conductor axially, and has an opening under the light interceptor, and (c) a first light emitter disposed under the light interceptor of the first light conductor, where the light from the first light emitter reflects axially of the knob via the opening and reaches to the lighting face, whereby even luminance is obtained, and also the switch can be assembled with ease at an inexpensive cost.

The invention defined in Claim 1 describes the lighting-knob-switch comprises the following elements:

(a) a first light conductor in a cylindrical shape or any other pillar shapes, having a light interceptor with a slope at a rear end and a lighting face at a front end, (b) a knob which houses the first light conductor axially, and has an opening under the light interceptor, and (c) a first light emitter disposed under the light interceptor of the first light conductor, (d) a case having an opening on a rear face and a bottom face, and a hole punched on a front face, (e) a movable shaft inserted into the hole rotatively as well as movable back and forth, and an extended part thereof being coupled with the knob, and (f) at least one of a rotary switch unit and a push switch unit which touches electrically a plurality of fixed contacts on and off by rotating or pressing of the knob via the movable shaft, where the light interceptor having a slope at the rear end of the first light conductor reflects the light from the first light emitter disposed thereunder axially of the knob and lights up the lighting face, whereby even luminance is obtained, and also the switch can be assembled with ease at an inexpensive cost because no lead wires are needed for coupling the first light emitter.

The invention further describes the invention, where a concave curve is provided to the slope of the light interceptor of the first light conductor. Thus, responding to a rotation angle of the knob (the range of the rotation angle is predetermined), the light from the first light emitter is reflected axially and led to the lighting face. As a result, an even illumination can be obtained when the knob moves back and forth or rotates, because the light from the first light emitter is reflected along the axis of the knob to reach to the lighting face due to the slope of the light interceptor against the back and forth moving, and the concave curve against the rotation.

The invention defined in further describes, where the lighting-knob-switch comprises the following elements:

(a) a first terminal plate disposed at rear face of the case, and having a plurality of fixed contacts on a front face of the first terminal plate, (b) a rotor housed in the case rotatively, and a front end of its rotative shaft being coupled rotatively with a rear end of the movable shaft, (c) a rotary switch unit mounted to the rear face of the rotor, having a first contact reed which touches on and off the fixed contacts on the first terminal plate, (d) a second terminal plate disposed on the rear side of the bottom plate, and having a plurality of fixed contacts thereon, (e) a slider movably housed in the case, and having a protrusion on its upper face being engaged with a lower face of the movable shaft, and (f) a push switch unit mounted on the bottom face having a second contact reed which touches on and off the fixed contacts of the second terminal plate, where, the first light emitter is mounted to the second terminal plate. Since the rotary switch unit is disposed behind the case, and the second terminal plate having the first light emitter thereon and the push switch unit are disposed on the rear face of the case bottom, the rotary switch and the push switch can be incorporated into the case. As a result, the entire size of the switch becomes smaller.

The invention further describes, where the lighting-knob-switch further comprises the following elements:

(a) a second light emitter disposed near the first light emitter, and (b) a second light conductor which conducts the light from the second light emitter to the light interceptor of the first light conductor. Since the light from the second light emitter is led to the light interceptor of the first light emitter through the second light conductor, various luminance color tones can be selected by changing emitting colors of the first and second light emitters.

The invention further describes, where the lighting-knob-switch further comprises the following elements: a protrusion disposed on one of the housing of the light conductor of the knob or on a periphery of the first light conductor, and a counter cavity disposed on the other one which has no protrusion. The first light conductor is to be inserted into the knob along only the inserting direction of the protrusion into the counter cavity, and cannot be inserted along any other directions. Thus, a miss-insertion of the first light conductor into the knob can be prevented.

DETAILED DESCRIPTION OF THE INVENTION

The embodiments of the present invention are described hereinafter by referring to FIG. 1 through FIG. 7. The elements described in the above sections use the same denotations and save detailed description.

Embodiment 1

Figure 1:
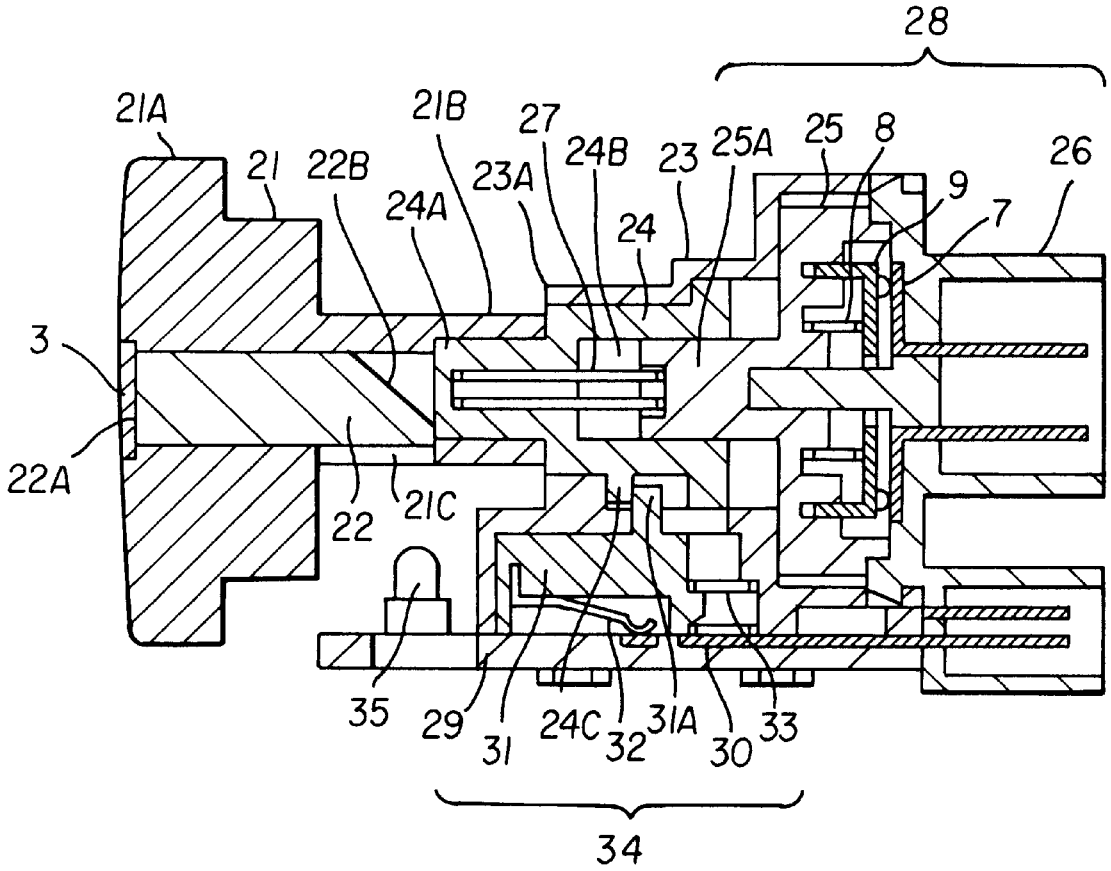
FIG. 1 is a cross section of a lighting-knob-switch used in Embodiment 1 of the present invention.
Figure 2:
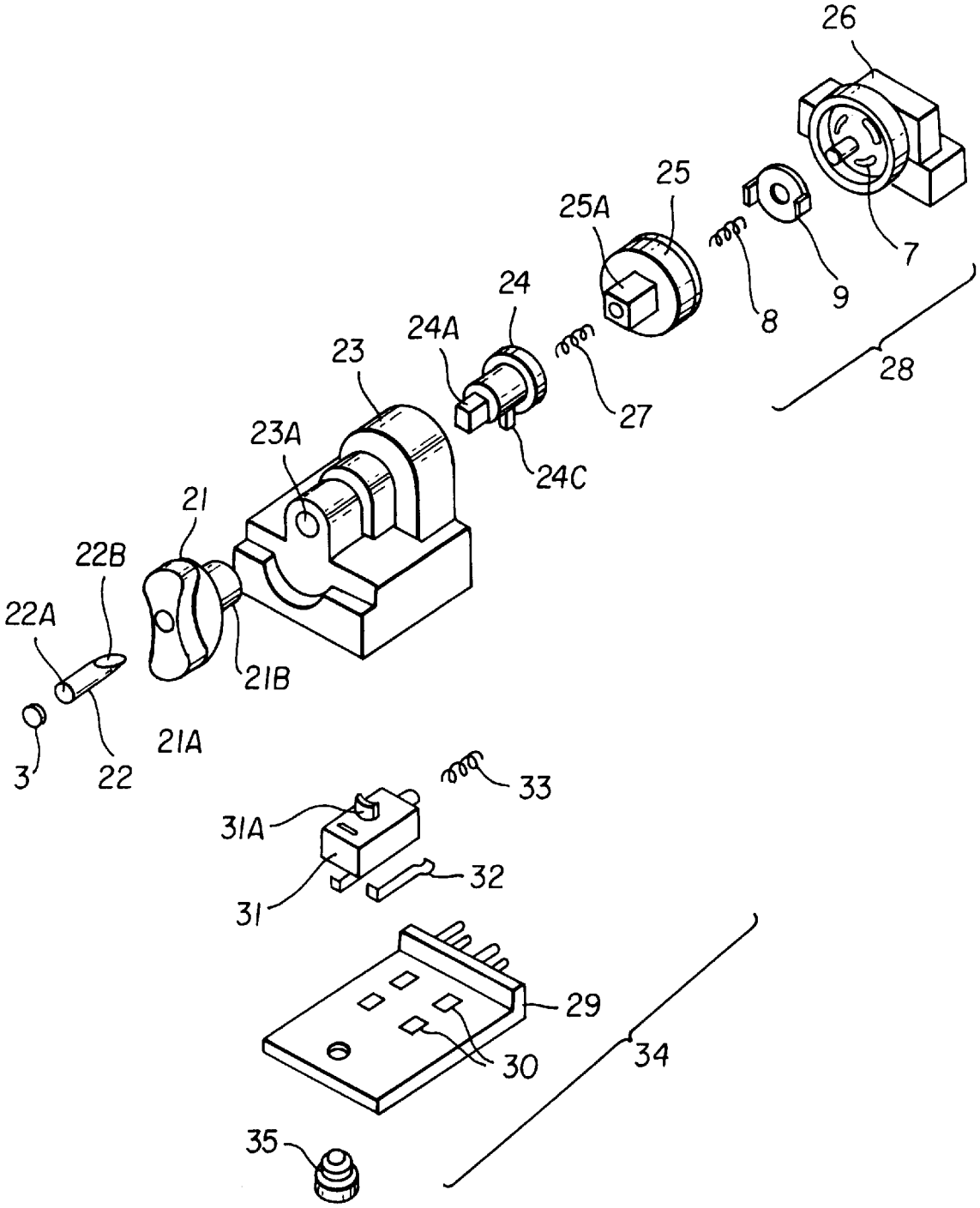
FIG. 2 is a exploded perspective view of the lighting-knob-switch shown in FIG. 1.

FIG. 1 is a cross section of a lighting knob switch used in Embodiment 1 of the present invention, and FIG. 2 is a exploded perspective view of the lighting knob switch shown in FIG. 1. In those drawings, the knob 21 made of plastic comprises a handle 21A and an engaging part 21B. The first light conductor 22 transparent and shaped in cylinder or the other pillars is engaged with a center of the knob 21 along its axial. The lighting face 22A is disposed to the front end of the first light conductor 22. The plate 3 on which characters of switch modes are illustrated is mounted to the lighting face 22A. The light interceptor 22B is disposed at rear end of the first light conductor 22 so that the upward light from the light disposed at lower level is processed as follows: (1) the light interceptor 22B has a slope with a substantial angle 45° in order to reflect the light along the knob axis so that the light is led to the lighting face 22A, (2) the light interceptor 22B has a concave slope in order to reflect the light to substantially a right angle responding to a rotation angle of the knob within a predetermined range so that the light is led to the lighting face 22A. An opening 21C is provided beneath the light interceptor 22B of the knob 21 so that the opening 21C appears within a predetermined rotation angle of the knob 21.

The case 23 has openings on the rear face and the bottom face, and also has the hole 23A on its front face. A movable shaft 24 is inserted into the hole 23A, and it is still rotative as well as movable back and forth. A protrusion 24A at the tip of the movable shaft 24 extends through the hole 23A to be engaged with an engaging part 21B.

The case 23 houses the rotor 25 rotatively, and at its rear face has the first terminal plate 26 on which front face a plurality of fixed contacts 7 are disposed. The rotor 25 has the rotative shaft 25A at its front part, and the rotative shaft 25A is inserted into the engaging hole 24B provided on the rear face of the movable shaft 24, at the same time, a restoring spring 27 is kept with some compression between the rear face of the protrusion 24A and the rotative shaft 25A, and the first contact reed 9 mounted to the rear face of the rotor 25 is forced to touch elastically the fixed contacts 7 by the pressure spring 8 mounted to the rotor 25, whereby the rotary switch unit 28 is constructed.

Beneath the bottom face of the case 23, the second terminal plate 29 having a plurality of fixed contacts 30 on its upper face is disposed. The case 23 also houses the slider 31 movably, and the second contact reed 32 of which tip makes elastic contact with the fixed contacts 30 is disposed beneath the slider 31. The protrusion 31A on the slider 31 is touched with the press part 24C disposed beneath the movable shaft 24. The restoring spring 33 with some compression is disposed between the rear face of slider 31 and the case 23. Thus the push switch unit is constructed. The first light emitter 35 such as a small bulb or a light emitting diode is mounted on the second terminal plate 29 under the light interceptor 22B of the first light conductor 22.

Figure 3:
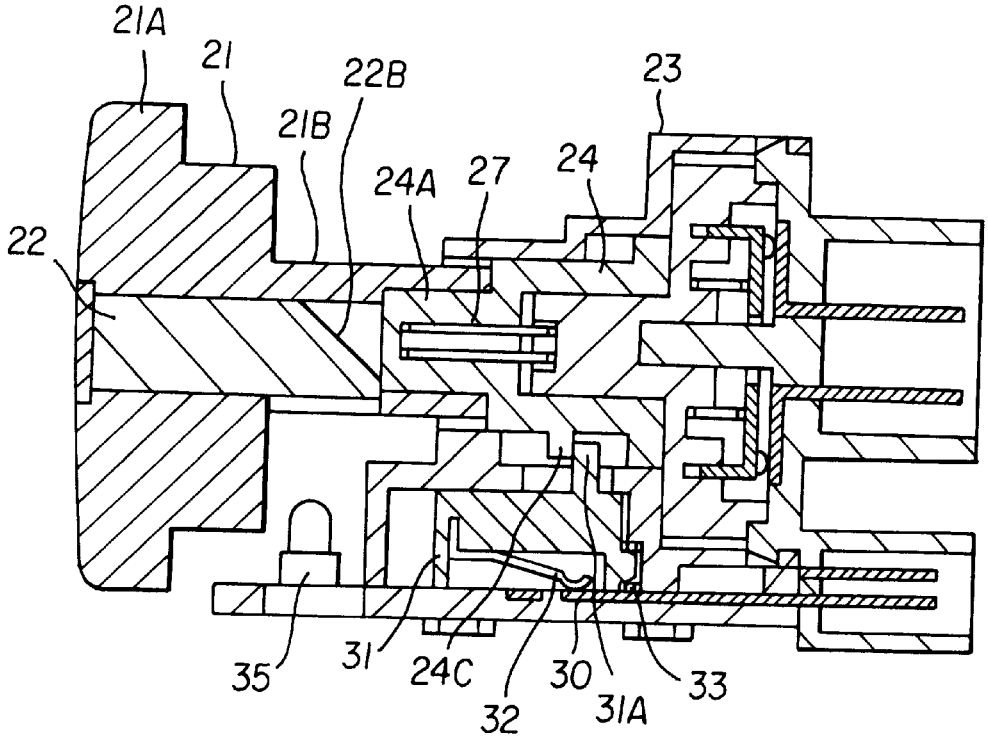
FIG. 3 is a cross section of the lighting-knob-switch in FIG. 1 when it is in a push operation.

In the above structure as shown in FIG. 3, when rotating the knob handle 21A, the rotor 25 is rotated by the movable shaft 24, then the first contact reed 9 is forced to rotate to touch elastically the fixed contacts 7 by the press spring 8, thereby the plurality of fixed contacts 7 are electrically on and off among themselves.

When pressing the knob handle 21A, the movable shaft 24 slides the restoring spring 27 by compressing in the case 23, at the same time, the press part 24C beneath the movable shaft 24 presses the protrusion 31A of the slider 31, and the slider 31 slides the restoring spring 33 by compressing in the case 23, thus the tip of second contact reed 32 disposed beneath the slider 31 slides elastically on the fixed contacts 30 thereby the plurality of the fixed contacts 30 can make contact with each other. When releasing the press, the restoring springs 27 and 33 restore the movable shaft 24 and the slider 31 respectively to the original position as shown in FIG. 1.

When lighting the first light emitter 35 mounted on the second terminal plate 29, the light runs through the opening 21C and arrives at the light interceptor 22B. Since the interceptor 22B has a slope with 45° substantial angle as well as a concave face which reflects and leads the upward light to the lighting face 22A, the light reflects to a substantial right angle and runs straight into the first light conductor 22 (to the left in Figs.) through the lighting face 22A to light up the switch mode characters on the plate 3.

Figure 4A:
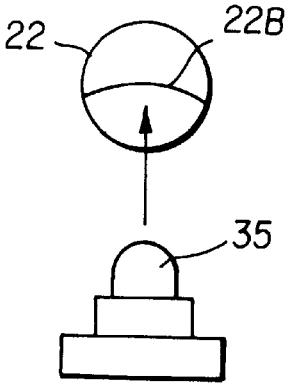
FIG. 4(*a*) and FIG. 4(*b*) are front views of an essential part of the lighting-knob-switch in FIG. 1.
Figure 4B:
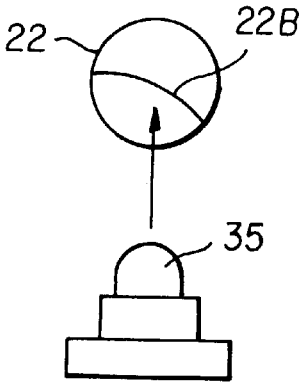

As shown in FIG. 4(*b*), when the light interceptor 22B is slanted by a rotation of the knob 21 and the first light emitter 35 is lit, since the light interceptor 22B has a concave slope to lead the upward light to the lighting face 22A, the light, having a substantial incidence angle of 45° which is approximately the same status as shown in FIG. 4(*a*) where the knob is not rotated, runs into the slope of the light interceptor 22B and reflects to a substantial right angle to run straight through the first light conductor 22 until the light lights up the lighting face 22A.

As shown in FIG. 3, when the knob 21 is depressed and the first light emitter 35 is lit, since the slope of the light interceptor 22B has substantial 45° angle, the light interceptor 22B reflects the upward light to a right angle so that the light reaches to the lighting face 22A. As long as the moving distance due to depressing the knob is within the range of the slope, the light from the first light emitter 35 runs to the slope having 45° angle of the light interceptor 22B, and then reflects to a right angle to further run straight into the first light conductor 22 until it lights up the lighting face 22A.

As described above, according to Embodiment 1, the concave slope having substantial 45° angle reflects the light from the first light emitter 35 to a substantial right angle, and the light runs straight through the first light conductor 22 to light up the lighting face 22A. Thus, even when the knob 21 is rotated or depressed, an even illumination can be obtained. Further the rotary switch unit 28 is disposed on the rear face of the case 23, and the second terminal plate 29 on which the first light emitter 35 is disposed as well as the push switch unit 34 is disposed beneath the case bottom face, whereby the rotary switch with a push mechanism is incorporated into the case 23. As a result, the lighting knob switch can be designed small in size and assembled with ease at an inexpensive cost.

In the above description, the rotary switch with the push mechanism is described as follows: "the movable shaft 24 is inserted into the hole 23A of the case 23 rotatively and movably," however; alternatives are available below:

(1) instead of the movable shaft 24, the rotative shaft 25A of the rotor 25 is directly engaged with the engaging part 211B of the knob 21, or (2) the movable shaft 24 is incorporated into the slider 31, so that an independent rotary switch or a push switch can be constructed.

Embodiment 2

Figure 5:
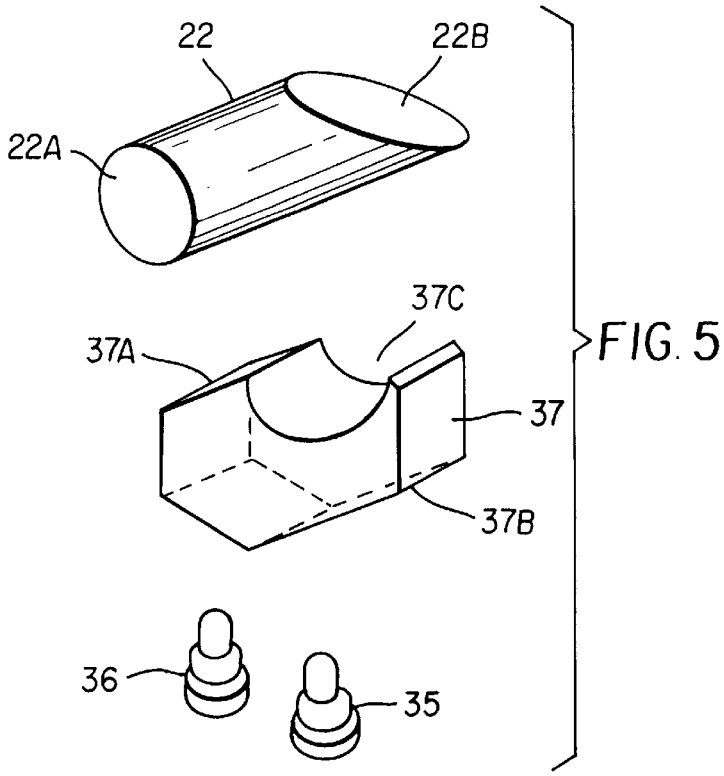
FIG. 5 is an exploded perspective view of an essential part of the lighting-knob-switch used in Embodiment 2 of the present invention.
Figure 6A:
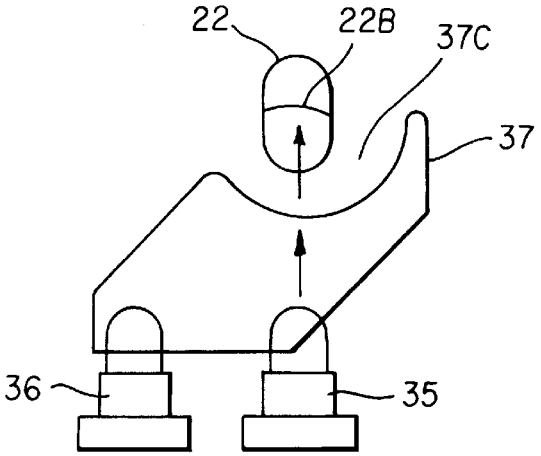
FIG. 6 is a front view of an essential part of the lighting-knob-switch used in Embodiment 2.
Figure 6B:
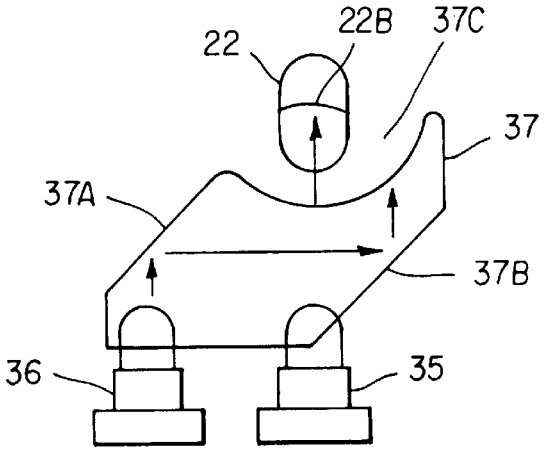

FIG. 5 is an exploded perspective view of an essential part of the lighting-knob-switch used in Embodiment 2 of the present invention. FIG. 6 is a front view of an essential part of the lighting-knob-switch used in Embodiment 2. As shown in those Figs., a second light emitter 36 such as a small bulb or a light emitting diode is mounted to a second terminal plate 29 (not shown) in parallel with the first light emitter 35. Under the first light conductor 22 housed in the knob 21 (not shown), a second light conductor 37 (transparent) is disposed. The second light conductor 37 comprises the following elements:

(a) a left side light interceptor 37A with a slope of 45° angle, (b) a right side light interceptor 37B with a slope of 45° angle, and (c) a lighting face 37C having a concave face along the circumference of the first light conductor 22.

As shown in FIG. 6(*a*), when the first light emitter 35 is lit, the light runs upward straight through the second light conductor 37 and lights up the lighting face 37C, whereby another light arrived at the light interceptor 22B reflects to a substantial right angle and runs straight through the first light conductor 22, and finally lights up the lighting face 22A. The story up to this point is the same as Embodiment 1.

As shown in FIG. 6(*b*), when the second light emitter 36 is lit, the light runs upward through the second light conductor 37, next, reflects to a right angle, runs through the second light conductor 37 to the right, then reflects to a right angle, lights up the lighting face 37C, arrives at the light interceptor 22B, and finally lights up the lighting face 22A, which is the same as the first light emitter 35 does.

According to Embodiment 2, the second light emitter 36 is disposed in addition to the first light emitter 35, and the second light conductor 37, which guides the light from the second light emitter 36 to the light interceptor 22B of the first light conductor 22, is disposed. In this construction, assume that the first light emitter 35 emits red color, and the second light emitter 36 emits green color, when the switch is not operated, the second light emitter 36 is lit so that the first light conductor 22 is illuminated in green, and when the switch is operated, the first light emitter 35 is lit so that the first light conductor 22 is illuminated in red. As such, an illuminating color tone on the knob can be selected by changing the emitting colors from the first light emitter 35 and the second light emitter 36.

Embodiment 3

Figure 7:
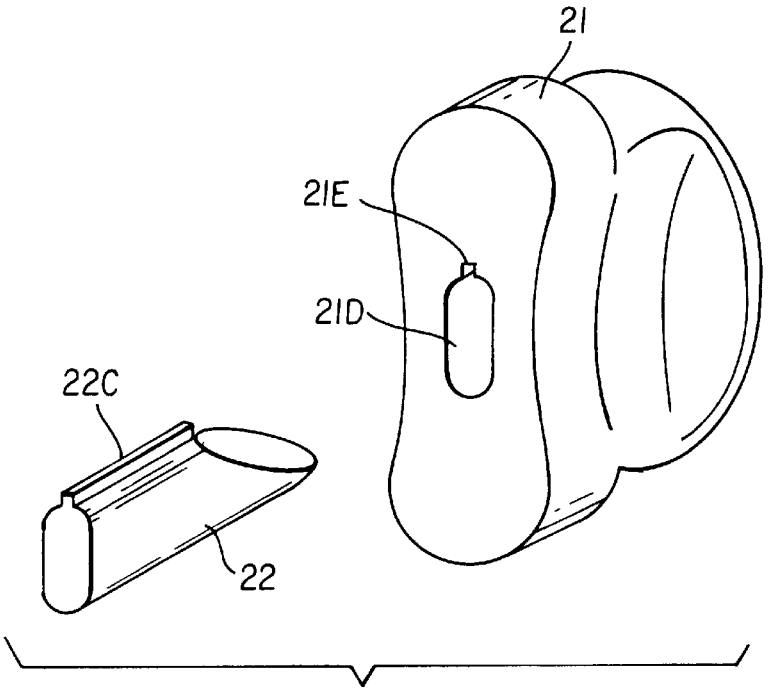
FIG. 7 is an exploded perspective view of an essential part of the lighting-knob-switch used in Embodiment 3 of the present invention.
Figure 8:
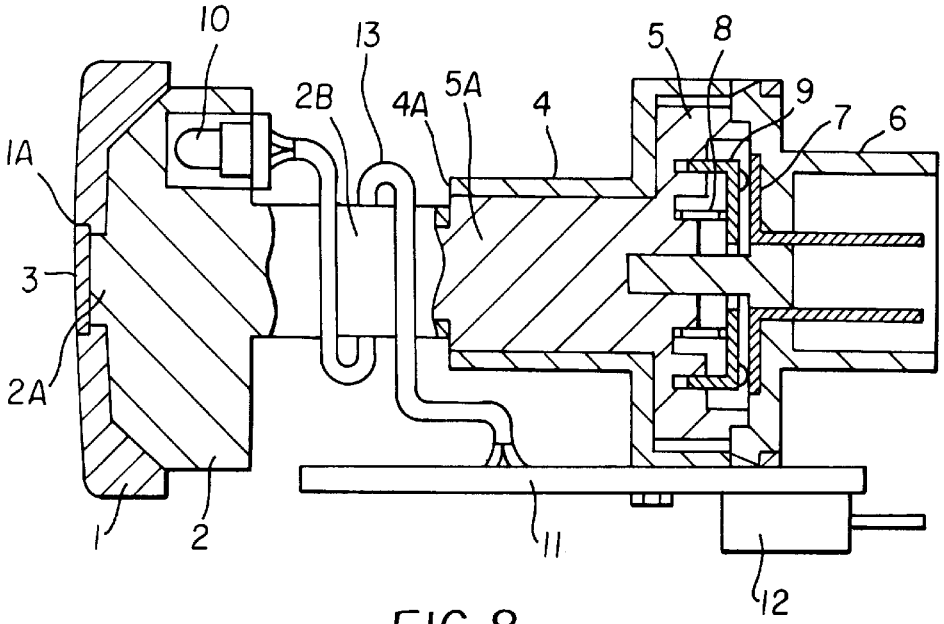
FIG. 8 (prior art)
FIG. 8 is a cross section of a conventional lighting-knob-switch.
Figure 9:
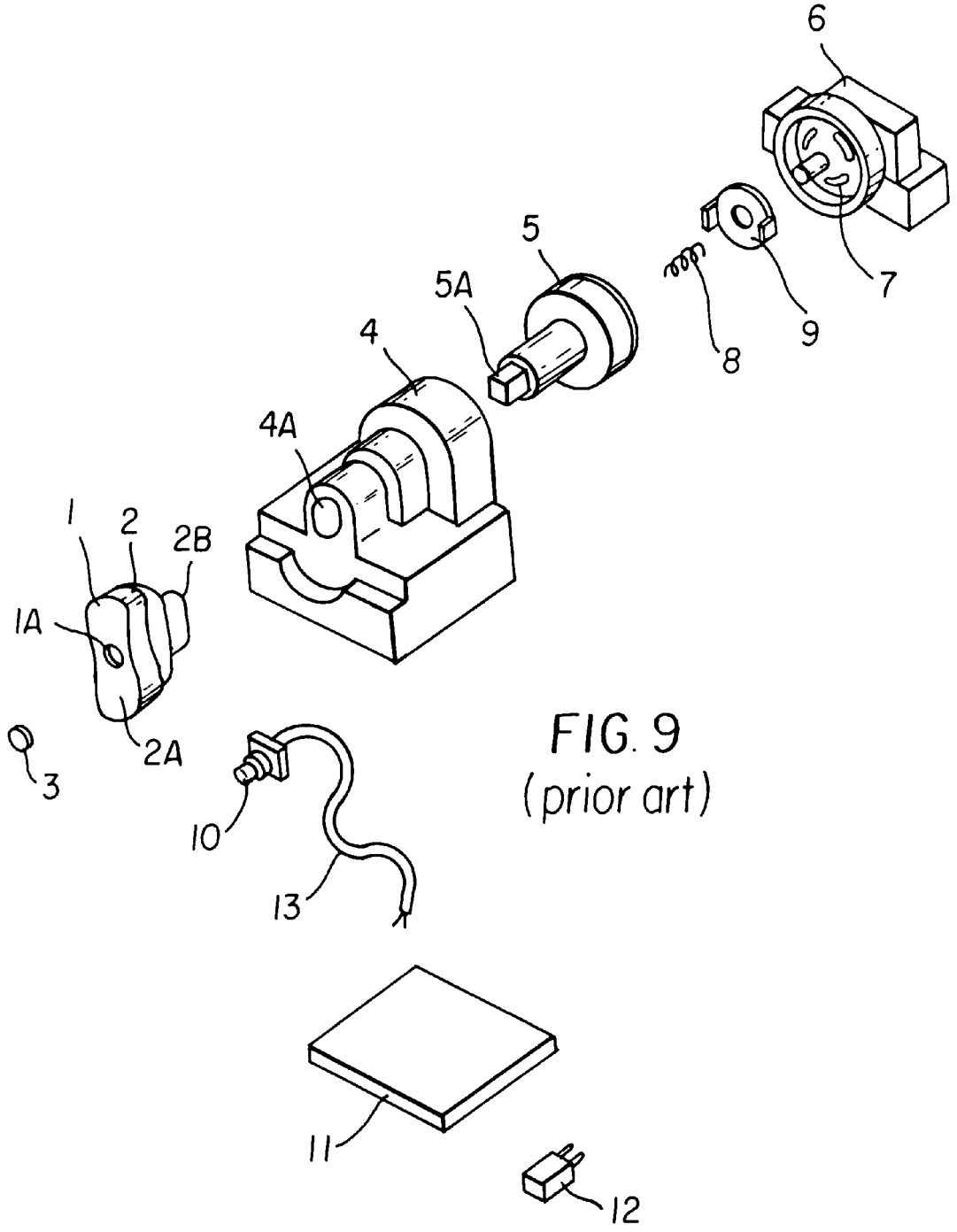
FIG. 9 (prior art)
FIG. 9 is an exploded perspective view of the conventional lighting-knob-switch.

FIG. 7 is an exploded perspective view of an essential part of the lighting-knob-switch used in Embodiment 3 of the present invention. A protrusion 22C is disposed on the upper side of the first light conductor 22, and a cavity 21E for receiving the protrusion 22C is disposed in a hole 21D of the knob 21 for housing a light conductor. This structure prevents the first conductor 22 from being inserted into the knob 21 upside down.

The above embodiments prove that the present invention provides a lighting-knob-switch which can be evenly illuminated and assembled with ease at an inexpensive cost.

What is claimed is:

1. A lighting-knob-switch comprising;

a first light conductor of which a rear end is a light interceptor having a slope, and of which a front end is a lighting face, said first light conductor being shaped in one of a cylinder and a pillar, a knob which houses said first light conductor axially, having an opening under said light interceptor, a first light emitter disposed under the light interceptor of the first light conductor, a case having an opening on a rear face and a bottom face, and a hole on a front face, a movable shaft inserted axially as well as rotatively into said hole punched on the front face of said case, a protrusion on a tip of said movable shaft being engaged with said knob, at least one of a rotary switch unit and a push switch unit wherein, the at least one of the electrically touching on and off a plurality of fixed contacts by said movable being driven by one of pressing and rotating the knob.

2. The lighting-knob-switch as defined in claim 1, wherein the slope of said light interceptor of the first light conductor has a concave face so that a light from the first light emitter reflects axially and arrives at the lighting face.

3. The lighting-knob-switch as defined in claim 1, further comprising;

a first terminal plate disposed at the rear face of said case, having a plurality of the plurality of fixed contacts on a front face thereof, a rotor movably housed in the case, and a rotative shaft on a front end thereof being rotatively coupled with a rear end of the movable shaft, the rotary switch unit having a first contact reed mounted to a rear face of said rotor, said first contact reed touching on and off the fixed contacts disposed on said first terminal plate, and a second terminal plate disposed beneath the bottom face of said case, having a plurality of the plurality of fixed contacts on an upper face thereof, a slider housed movably in said case, having a protrusion on an upper face thereof, said protrusion being engaged with a lower face of said movable shaft, and the push switch unit having a second contact reed disposed under said slider, and touching on and off the fixed contacts disposed on said second terminal plate, wherein, the first light emitter is mounted to said second terminal plate.

4. The lighting-knob-switch as defined in claim 2, further comprising;

a first terminal plate disposed at the rear face of said case, having a plurality of the plurality of fixed contacts on a front face thereof, a rotor movably housed in the case, and a rotative shaft on a front end thereof being rotatively coupled with a rear end of the movable shaft, the rotary switch unit having a first contact reed mounted to a rear face of said rotor, said first contact reed touching on and off the fixed contacts disposed on said first terminal plate, and a second terminal plate disposed beneath the bottom face of said case, having a plurality of the plurality of fixed contacts on an upper face thereof, a slider housed movably in said case, having a protrusion on an upper face thereof, said protrusion being engaged with a lower face of said movable shaft, and the push switch unit having a second contact reed disposed under said slider, and touching on and-off the fixed contacts disposed on said second terminal plate, wherein, the first light emitter is mounted to said second terminal plate.

5. The lighting-knob-switch as defined in claim 1, 2, 3, or 4 further comprising;

a second light emitter disposed near the first light emitter, a second light conductor for guiding a light from the second light emitter to the light interceptor of the first light conductor.

6. The lighting-knob-switch as defined in claim 1, 2, 3 or 4 further comprising:

a protrusion disposed on one of a housing part of the light conductor of the knob and a circumference of the first light conductor, a cavity disposed on one of the housing part of the light conductor of the knob and the circumference of the first light conductor whichever being free from the protrusion, said cavity accepting said protrusion.

7. The lighting-knob-switch as defined in claim 5 further comprising:

a protrusion disposed on one of a housing part of the light conductor of the knob and a circumference of the first light conductor, a cavity disposed on one of the housing part of the light conductor of the knob and the circumference of the first light conductor whichever being free from the protrusion, said cavity accepting said protrusion.

* * * * *